US006993963B1

(12) United States Patent
Gudmundsson

(10) Patent No.: US 6,993,963 B1
(45) Date of Patent: Feb. 7, 2006

(54) METHOD FOR DETERMINING PRESSURE PROFILES IN WELLBORES, FLOWLINES AND PIPELINES, AND USE OF SUCH METHOD

(76) Inventor: Jon Steinar Gudmundsson, Ovre Mollenberg 56, N-7014 Trondheim (NO)

( * ) Notice: Subject to any disclaimer, the term of this patent is extended or adjusted under 35 U.S.C. 154(b) by 231 days.

(21) Appl. No.: 10/380,480

(22) PCT Filed: Sep. 22, 2000

(86) PCT No.: PCT/NO00/00311

§ 371 (c)(1),
(2), (4) Date: Mar. 21, 2003

(87) PCT Pub. No.: WO02/25062

PCT Pub. Date: Mar. 28, 2002

(51) Int. Cl.
*E21B 49/00* (2006.01)

(52) U.S. Cl. ..... 73/152.52

(58) Field of Classification Search ..... 73/152.51, 73/152.52, 152.53, 49.1, 37.5, 168, 865.8
See application file for complete search history.

(56) References Cited

U.S. PATENT DOCUMENTS 4,677,849 A * 7/1987 Ayoub et al. ..... 73/152.37

* cited by examiner

*Primary Examiner*—Robert Raevis
(74) *Attorney, Agent, or Firm*—Dennison, Schultz, Dougherty & MacDonald

(57) ABSTRACT

Method for determining pressure profiles in wellbores, flowlines and pipelines flowing singlephase and multiphase fluids and use of such a method. The flow is temporarily stopped or restricted with a quick acting valve and the pressure is continuously recorded at a point a short distance upstream, using the Joukowsky equation: $\Delta p_a=\rho\ u\ a$, where $\rho$(kg/m3) represents the fluid density, u(m/s) the fluid flowing velocity and a (m/s) the speed of sound in the fluid, to estimate the magnitude of the water hammer and using the Darcy-Weisbach equation: $\Delta_f=(f/2)(\Delta L/d)\rho u^2$, where f (dimensionless) is the friction factor, L (m) the pipe length, d (m) pipe diameter, (kg/m3), $\rho$ (kg/m3) fluid density and u (m/s) fluid velocity, to determine the frictional pressure drop, thereby obtaining a time-log of the pressure change in the wellbore, flowline or pipeline measured. A distance-log of pressure change may be obtained from the time-log and an estimate of the speed of sound in the actual multiphase flow media, using the formula: $\Delta L=0.5\ a\Delta t$, to obtain the relation between time ($\Delta t$) and distance ($\Delta L$). The method is useful for detecting and locating leakages, inflow, deposits, collapses etc.

12 Claims, 5 Drawing Sheets

Effect of 500 m long deposit on line-packing pressure.

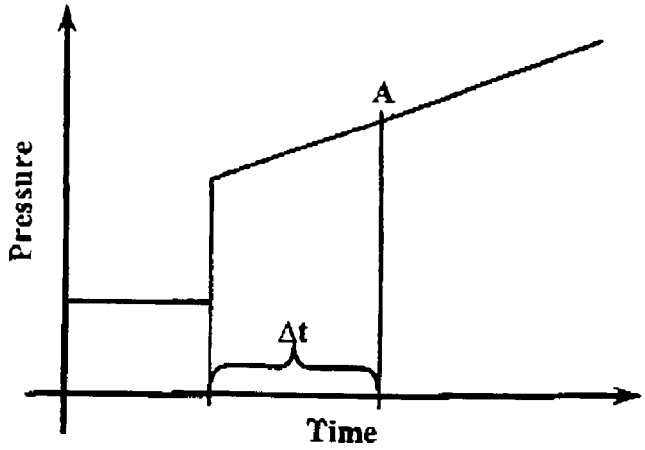
Figure 1 - Line packing increases linearly with time.
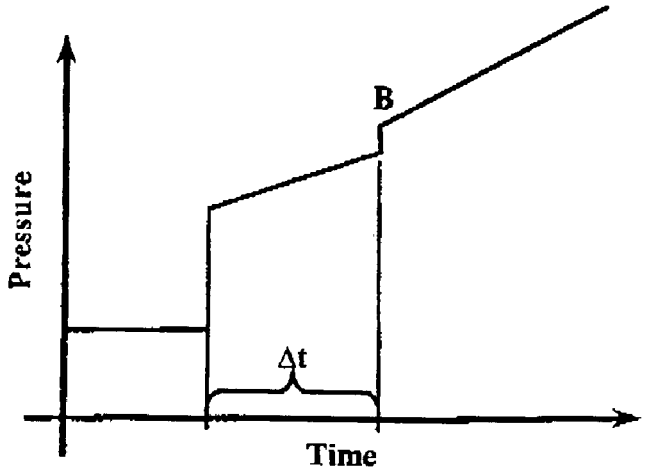
Figure 2 - Change in tubing diameter.
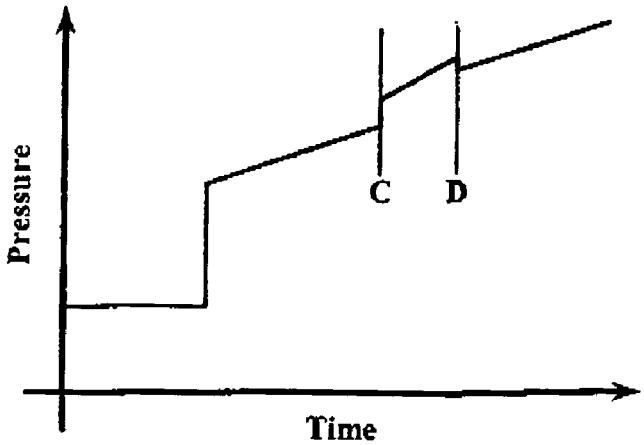
Figure 3 - Tubing diameter reduced in interval C-D.

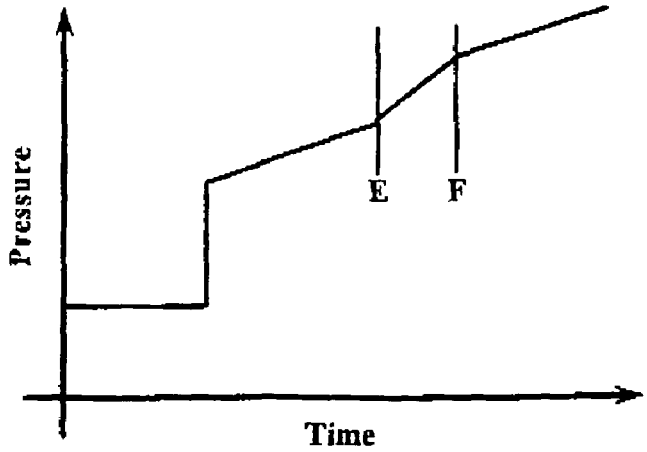
Figure 4 - Friction increased in interval E-F.
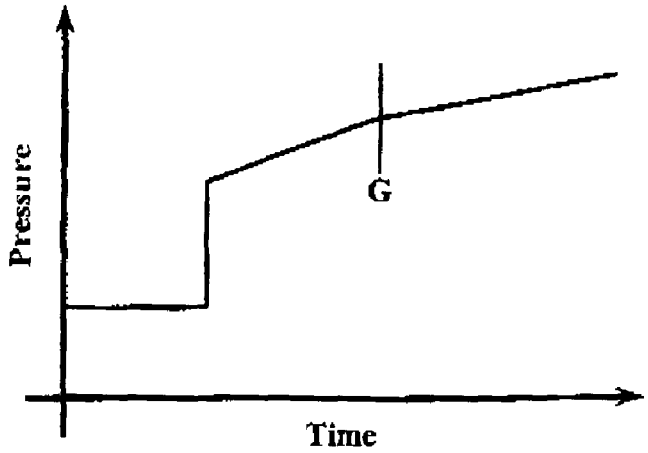
Figure 5 - Flowrate changes.
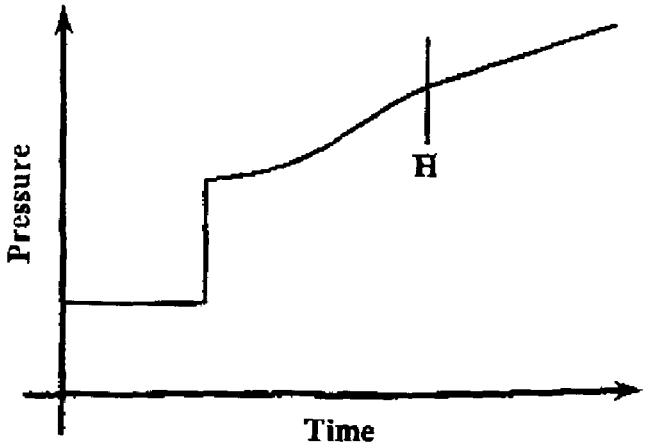
Figure 6 - Multiphase transition.

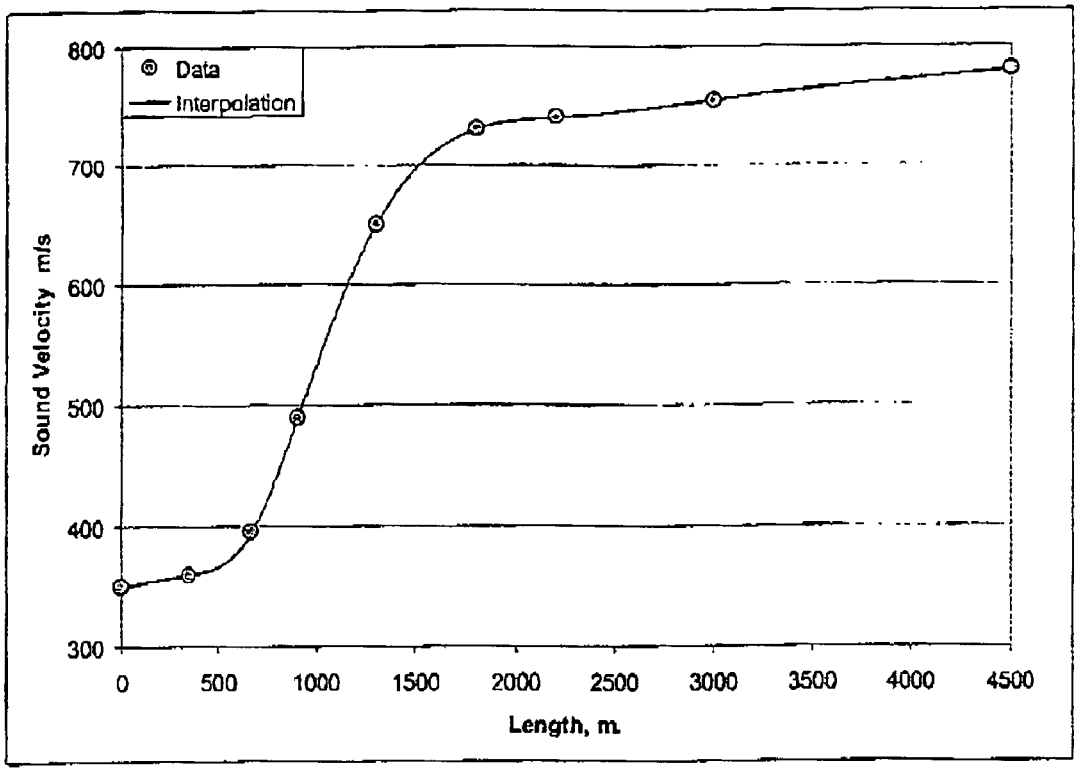
Figure 7 - Speed of sound profile.
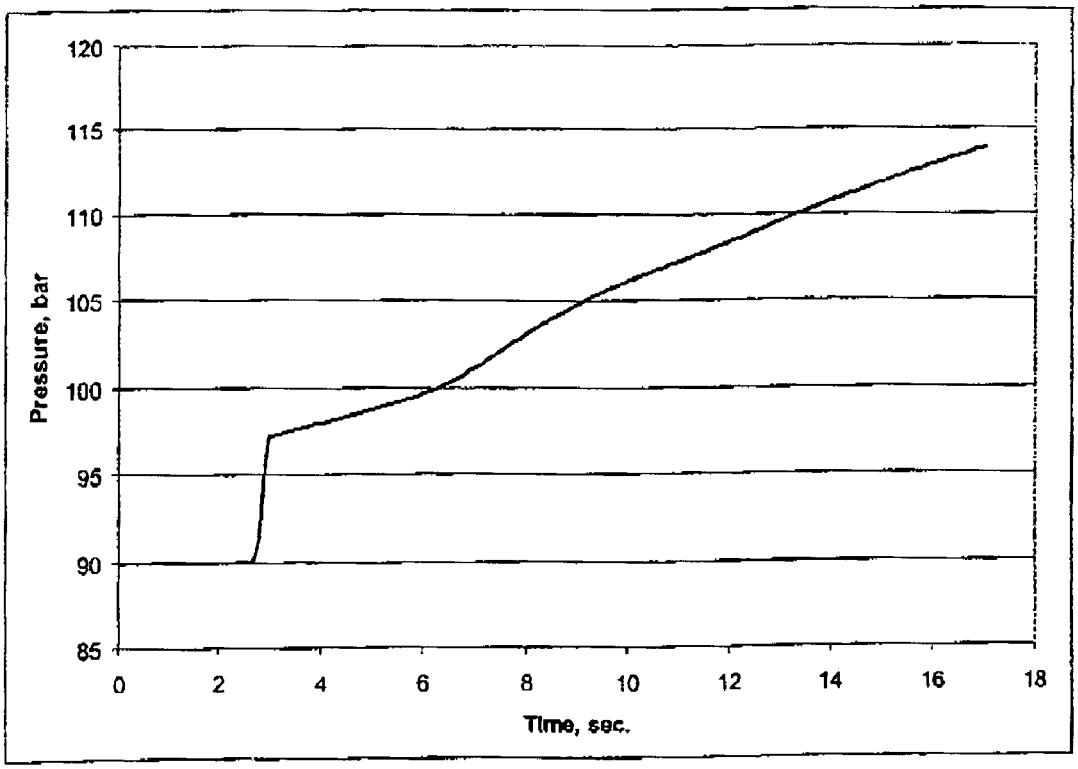
Figure 8 - Wellhead pressure.

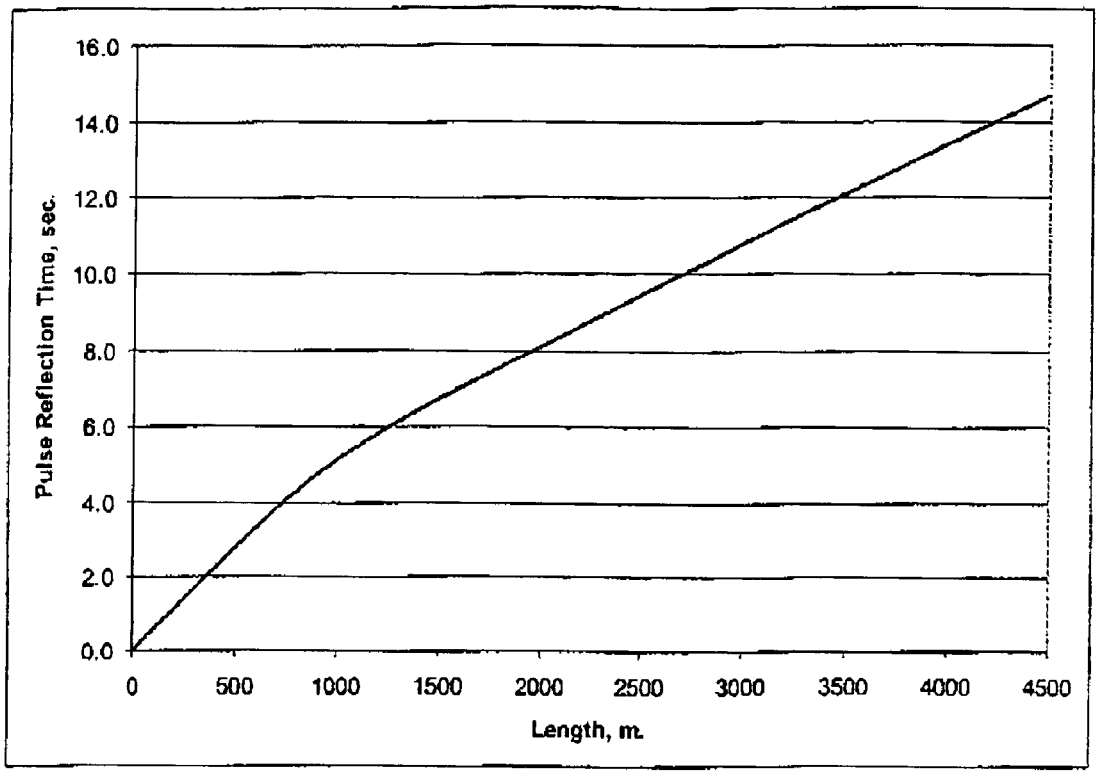
Figure 9 - Pulse reflection time.

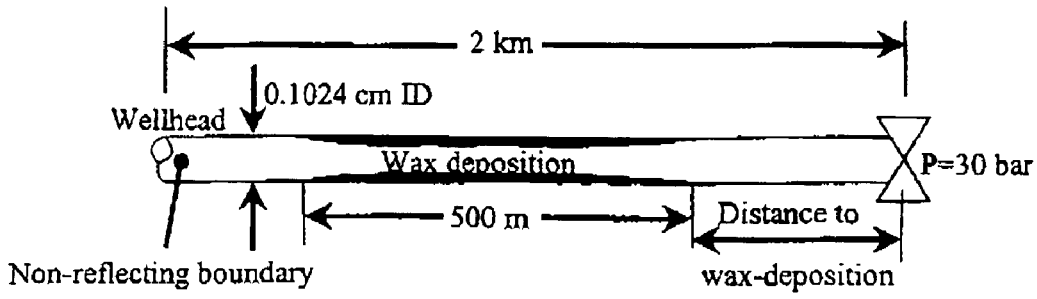
Figure 10 - Wax deposition in flowline.
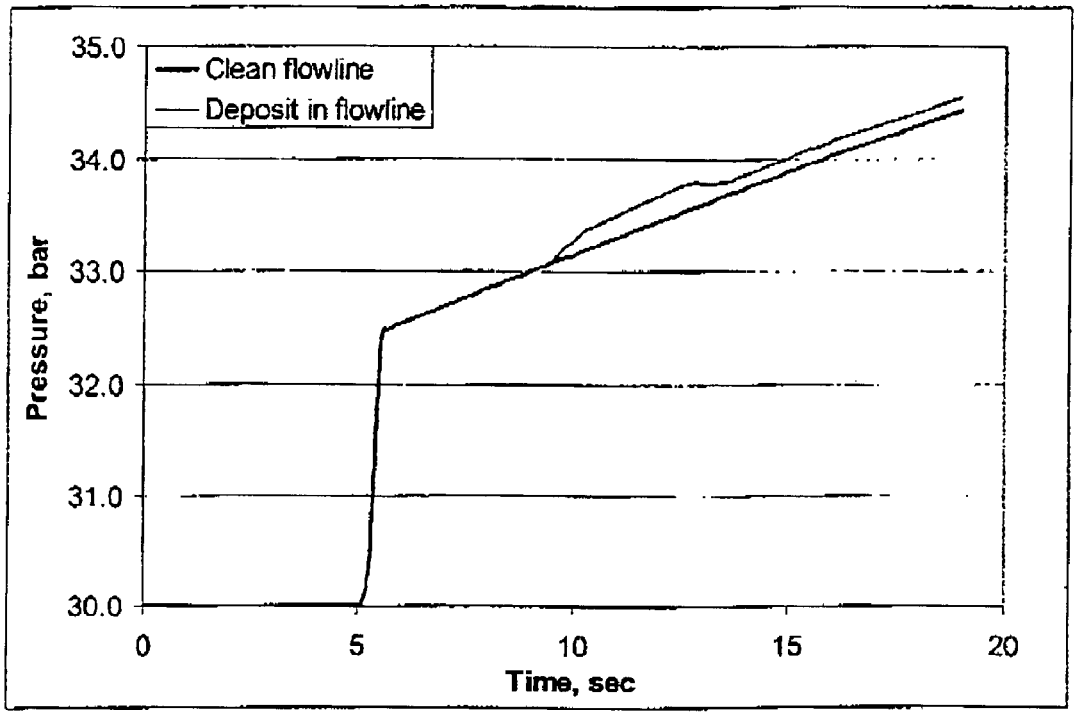
Figure 11 - Effect of 500 m long deposit on line-packing pressure.

METHOD FOR DETERMINING PRESSURE PROFILES IN WELLBORES, FLOWLINES AND PIPELINES, AND USE OF SUCH METHOD

The present invention concerns a method to determine pressure profiles in wellbores and pipelines that are flowing single-phase and multiphase-fluids as well as several uses of said method.

BACKGROUND

Hydrocarbon fluids are produced by wells drilled into offshore and land-based reservoirs. The wells range in depth and length from a few hundred meters to several kilometers. Various wellbore designs (completions) are used for the different situations found in offshore and land-based hydrocarbon reservoirs. The complexity of wellbore design has increased with time, as new ways are found to produce oil and gas reservoirs more economically. Concurrently, the need for wellbore monitoring has increased, including fluid flow, wellbore condition and completion integrity.

The traditional way to measure downhole fluid flow conditions is to use a production logging tool (PLT), as presented by Hill (Hill, A. D. (1990): *Production Logging—Theoretical and Interpretive Elements*, Society of Petroleum Engineers, Monograph, Volume 14, 154 pp.). Such tools are primarily used to measure the downhole pressure, temperature and fluid velocity. Other properties can also be measured using PLT=s, depending on the particular wellbore condition or problem being investigated. Fluid velocity is normally measured using a spinner, as presented by Kleppan, T. and Gudmundsson, J. S. (1991): *Spinner Logging of a Single Perforation*, Proc., 1st Lerkendal Petroleum Engineering Workshop, Norwegian Institute of Technology, Trondheim, 69–82.

In recent years the practice of installing permanent pressure and temperature gauges has increased. Unneland and Haugland (Unneland, T. and Haugland T. (1994): *Permanent Downhole Gauges Used in Reservoir Management of Complex North Sea Oil Fields*, SPE Production and Facilities, August, 195–201) have estimated the pay back period for a gauge installation in a field where production is limited by well capacity. The analysis showed that running a PLT typically requires 28 hours shut-in, including shut-in of neighbouring wells for safety reasons. As individual well rates vary between 500 and 5000 Sm3/day (3000–30,000 bbl/day), this represents a significant production deferment. The cost of the deferred production depends on several parameters. A common factor to the most important parameters is that the cost is highest early in the life of the well when the information is most important.

Assuming an average oil price of 20 US$/bbl the deferred production cost for the above example, will be in the range 70,000–700,000 US$. The cost of running a PLT on an offshore platform will typically be about 100,000 US$. The cost of installing a permanent pressure gauge will be about 180,000 US$. Unneland and Haugland (1993) concluded that the average pay back period for permanent gauge installations is less than one year.

Permanent downhole gauges measure the pressure at one particular depth. They are typically installed above the perforated interval in oil and gas wells. Pressure measurements from permanently installed downhole gauges are used to monitor the pressure behavior with time in production wells; for example, for pressure transient analysis purposes.

Provided fluid flow measurements are also available, the pressure measurements can be used to monitor well performance with time.

An important limitation of permanent downhole pressure gauges is that they are fixed at one location (depth). It means that permanent downhole gauges cannot be used to measure the pressure profile with depth in oil and gas wells. However, a PLT can be used to measure the pressure profile with depth, in both shut-in and flowing wells. The cost of running one PLT in typical offshore wells in the North Sea was above reported to cost 70,000–700,000 US$ in deferred production and about 100,000 US$ in direct expenses. Furthermore, when running a PLT in a flowing well, the well will normally be routed through the test separator. It means that the availability of the test separator for more routine production testing is reduced.

Multiphase metering technology for offshore and land-based oil production operations has developed rapidly in recent years and decades, as evident from the many conferences on the subject, including the North Sea Metering Conference, held alternately in Norway and Scotland. The BHR Group conference on Multiphase Production in Cannes, is another example of the importance of gas-liquid flow in hydrocarbon production and processing. Multiphase metering is also well represented at the many conferences of the Society of Petroleum Engineers. Some of the fundamentals and practical aspects of multiphase flow in petroleum production operations are presented by King (King, N. W. (1990): *Multi-Phase Flow in Pipeline Systems*, National Engineering Laboratory, HMSO, London.).

Multiphase metering methods, based on the propagation of pressure pulses in gas-liquid media, have been patented by Gudmundsson (Norwegian patents Nos. 174 643 and 300 437). The first of these is based on generating a pressure pulse using a gas-gun, and measuring the pressure pulse up-stream and down-stream near the gas-gun and at some distance. The second of these is based on generating a pressure pulse by closing a quick-acting valve, and measuring the pressure pule up-stream near the valve and at some distance; the pressure pulse can also be measured up-stream near the valve and down-stream near the valve and at some distance. Other pressure pulse measurement locations can also be used, depending on the metering needs and system configuration.

A production logging tool (PLT) is commonly used in flowing oil and gas wells to investigate the condition of the wellbore, in particular problems that arise with time in production wells. Such problems include tubing and/or casing failures and the deposition of solids in the wellbore. A caliper tool can be included in a PLT-string or run independently. PLTs are also used to detect which gas-lift valve is operational and whether perforations in a gravel-pack are blocked. The term pressure survey is sometimes used by operators to describe the measurement of pressure with depth in oil and gas wells.

The operators of oil and gas wells are reluctant to put tools into the wellbore, because of the risk involved. Tools sometimes become stuck in the wellbore, resulting in greater problems than what the operators wanted to investigate. Workover is a term used in the oil and gas industry when wells are being repaired. Depending on the problem that needs fixing, such operations may be preceded by running PLT=s.

The principles behind running pressure surveys in wellbores, apply also in flowlines and pipelines. Such pressure surveys/measurements can be used to detect flowline/pipeline failures and the location and magnitude of deposits such as hydrates, wax, asphaltenes and sand. The problems caused by solids deposition in hydrocarbon production and processing have been the subject of many conferences, including A *Controlling Hydrates, Waxes and Asphaltenes*@ in Oslo, Dec. 7–8, 1998 (IBC UK Conferences Limited). The detection of flowline/pipeline failures includes leak detection. Pressure surveys/measurements can also be used to locate and quantify the performance of flow equipment used in oil and gas production and processing.

A major problem in making pressure surveys in flowlines and pipelines carrying gas-liquid mixtures, is the great difficulty in making continuous measurements along the flow path. Instead, pipeline pressure measurements are usually made at discrete points. Due to the limited number of discrete pressure points practicable, pressure measurements in flowlines and pipelines are usually not suitable to detect and monitor deposits and leaks. Clearly, discrete measurements are more difficult in subsea pipelines than land pipelines. The only practical exception is the use of sound waves in single-phase flow pipelines to detect and locate leaks.

Objective

A main objective of the present invention is to provide a method to determine the pressure profile in wellbores, flowlines and pipelines that are flowing singlephase and multiphase fluids in the petroleum industry and related industries.

Another objective is to provide such a method which does not require expensive equipment and does not involve tools with the potential risk of getting stucked when brought into the wellbore, flowline or pipeline.

Another objective is to provide a method to determine the pressure profile with the purpose to be able to detect and locate problem areas like collapse, deposits, leakages or the like in the wellbore, flowline or pipeline.

These and other objectives are fulfilled by means of the method according to the invention.

The Invention

The invention relates to a method for determining pressure profiles in wellbores, flowlines and pipelines, said method being defined by the characterizing part of claim 1.

Preferred embodiments of the invention is defined by the dependent claims.

Furthermore, the invention relates to use of said mathod for different purposes as defined by the claims 6–12.

Mathematical Basis for the Invention

The present invention may be seen as an extension of the previous inventions of Gudmundsson (Norwegian patents Nos. 174 643 and 300 437). The previous inventions are based on the propagation of pressure waves/pulses in gas-liquid mixtures. In particular, when a quick-acting valve located near the wellhead of an offshore production well is activated, a pressure wave/pulse will be generated. The pressure pulse will propagate both up-stream and down-stream of the quick-acting valve. The magnitude of the pressure pulse will be governed by the water-hammer equation, also called the Joukowsky equation:

$$\Delta p_a=\rho\ u\ a, \tag{1}$$

where ρ (kg/m3) represents the fluid density, u (m/s) the fluid flowing velocity and a (m/s) the speed of sound in the fluid. The speed of sound in the fluid is equivalent to the propagation speed of the pressure pulse generated.

The magnitude of the pressure pulse generated by a quick-acting valve can be measured immediately up-stream by using a pressure transducer. In flow systems where the up-stream and down-stream pipes (wellbore, flowline, pipeline) are sufficiently long, the pressure increase immediately up-stream of the quick-acting valve, will be the same as given by the water-hammer equation.

A pressure pulse travelling into a wellbore producing an oil and gas mixture, will arrest the flow; that is, the pressure pulse will stop the flow. The pressure pulse will travel into the wellbore at the in-situ speed of sound. Therefore, the oil and gas will be brought to rest as quickly as the pressure pulse travels down into the wellbore. In principle, when the pressure pulse has reached the bottom on the well, the fluid velocity in the wellbore will be reduced to practically zero.

As the flow is brought to rest, the pressure loss due to wall friction will be made available. That is, the pressure drop due to gas-liquid mixture flow in the wellbore, will be released. This frictional pressure drop will propagate continuously to the wellhead and can be measured and is often called line-packing.

Frictional pressure drop in pipes (wellbores, flowlines, pipelines) is governed by the Darcy-Weisbach equation:

$$\Delta p_f=(f/2)(\Delta L/d)\ \rho\ u\hat{}2 \tag{2}$$

where f (dimensionless) is the friction factor, ΔL (m) pipe length, d (m) pipe diameter, ρ (kg/m3) fluid density and u (m/s) fluid velocity. The Darcy-Weisbach equation as shown here holds for single-phase laminar and turbulent flow. In principle, the equation can be extended to hold also for multiphase flow. There are many such extensions presented in various books on multiphase flow (G. Wallis, A *One-Dimensional Two-Phase Flow*@, McGraw-Hill, 1969, and P. B. Whalley, A *Boiling, Condensation and Gas-Liquid Flow*@, Oxford University Press, New York, 1987).

The Darcy-Weisbach equation can be written in terms of the pressure gradient:

$$(\Delta p_f)/\Delta L=(f/2)(1/d)\ \rho\ u\hat{}2 \tag{3}$$

The friction factor in single-phase and multiphase flows can be obtained from semi-empirical relationships such as the Blasius-equation:

$$f=(0.0791)/Re\hat{}0.25 \tag{4}$$

where Re is the Reynolds number given by:

$$Re=(\rho\ u\ d)/\mu \tag{5}$$

The Blasius-equation is used when the flow is hydrodynamically smooth. If the flow is rough, the Colebrook-White equation can be used:

$$(1/f)\hat{}0.5=-2\ \log\ [(2.51)/(Re\ f\hat{}(-1))+(k_s/(3.7\ d))] \tag{6}$$

where k_s is the sand-grain roughness.

The density of a gas-liquid mixture is given by the relationship:

$$\rho_M=\alpha\rho_G+(1-\alpha)\rho_L \tag{7}$$

where α (dimensionless) is the void fraction and the subscripts stand for M (mixture), G (gas) and L (liquid). In hydrocarbon production the liquid-phase will often consist of oil and water.

The speed of sound in homogenous gas-liquid mixtures a_M is given by the traditional Wood equation, here expressed as:

$$a_M=(A\ B)\hat{}-1 \tag{8}$$

where:

$$A=[\alpha\rho_G+(1-\alpha)\rho_L]\hat{}0.5 \text{ and:} \tag{9}$$

$$B=[(\alpha/(\rho_G\ a\hat{}2_G))+((1-\alpha)/(\rho_L\ a\hat{}2_L))]\hat{}0.5 \tag{10}$$

Note that a_G and a_L are the speed of sound in gas and liquid, respectively. Dong and Gudmundsson (Dong, L. and Gudmundsson, J. S. (1993): *Model for Sound Speed in Multiphase Mixtures*, Proc. 3rd Lerkendal Petroleum Engineering Workshop, Norwegian Institute of Technology, Trondheim, 19–30.) derived a similar equation for petroleum fluids.

The above equations show that the flow in land-based and offshore wellbores, flowlines and pipelines depends on many factors. Additional factors are the pressure, volume and temperature behaviour of the fluid mixtures involved. It is convenient to illustrate the invention by assuming several of the above factors as constant. Later, in practical situations, such assumption can be relaxed and the various effects can be taken into consideration.

DETAILED DESCRIPTION WITH REFERENCE TO THE DRAWINGS

In the following the present invention is described in further detail and with reference to accompanying drawings, where:

FIGS. 1–6 show time-logs of pressure changes for a number of different theoretical flow-situations, FIG. 7 shows the variation of the speed of sound with depth in a wellbore (practical case), FIG. 8 shows a time-log of pressure variation registered according to the method of the present invention from the wellbore of FIG. 7, FIG. 9 shows a plot of the correlation between pulse reflection and depth for the practical case according to FIGS. 7 and 8, FIG. 10 is an illustration of wax-deposition in a certain region of a flowline or pipeline, and FIG. 11 is a time-log (practical case) of the pressure change measured along the deposited flowline or pipeline according to FIG. 10, measured according to the present invention.

Assuming single-phase flow in a wellbore; assuming a constant wellbore diameter; assuming a constant friction factor; assuming a constant flowrate; assuming a constant in-situ speed of sound, and; assuming a constant fluid viscosity, the line-packing measured at the wellhead after full/complete closing of a quick-acting valve, will increase linearly with time. Furthermore, assuming that the quick-acting valve closes instantaneously, the pressure increase with time for such conditions is illustrated in FIG. 1. For any point A the pressure measured represents the wellbore line-packing the distance ΔL up-stream (into the wellbore):

$$\Delta L = 0.5\ a\ \Delta t \tag{11}$$

where Δt (s) is the time. The factor 0.5 is applied because the pressure pulse must first travel down to point A and then back to the wellhead.

The assumption of constant wellbore diameter can be relaxed to illustrate the situation where a smaller diameter tubing is used below a certain depth; that is, an abrupt and significant step-change in diameter. The pressure increase with time for such a condition is illustrated in FIG. 2. The point B represents the distance from the wellhead to the change in tubing diameter. A part of the pressure wave/pulse is reflected from the transition and back to the wellhead, hence the step-increase in pressure, and a part of the wave/pulse is transmitted further into the wellbore. Because the tubing diameter below the depth of point B is smaller than above, the frictional pressure gradient is larger.

The assumption of a constant wellbore diameter can be relaxed to illustrate the situation where the tubing diameter has been reduced in a certain interval. The tubing diameter reduction is an abrupt and significant and exists for some distance, until the diameter expands abruptly and significantly. The pressure increase with time for such a condition is illustrated in FIG. 3. The point C represents the distance from the wellhead to the reduction in tubing diameter, and the point D represents the distance from the wellhead to the return to full tubing diameter. Such a reduction in tubing diameter may result from tubing collapse or the deposition of solids in the particular interval.

The assumption of a constant friction factor can be relaxed to illustrate the situation where the friction factor increases in a certain interval. An increase in friction factor will result in similar effects as a decrease in diameter, as evident from the Darcy-Weisbach equation. The increase in friction factor increases the frictional pressure gradient in the interval, as illustrated in FIG. 4. The point E represents the distance from the wellhead where wellbore friction increases, and the point F represents the distance from the wellhead where wellbore friction decreases. It needs to be recognised that the deposition of solids in a certain interval and resulting in reduced tubing/wellbore diameter, may be accompanied by a change in friction factor.

The assumption of constant flowrate can be relaxed to illustrate the effect of added fluid inflow at a particular wellbore depth. The pressure increase with time for such a condition is illustrated in FIG. 5. The point G represents the distance from the wellhead to the depth where the flowrate increases. The flowrate below point G is less than the flowrate above point G. Oil and gas wells are sometimes completed with more than one perforated zone, and sometimes with one or more sidetracks or multilaterals. The fluids entering a wellbore from such zones and laterals will increase the flowrate and thus affect the pressure profile.

The assumption of single-phase flow and the assumption of constant speed of sound can be relaxed together to illustrate the effect of multiphase flow in the wellbore. The viscosity will also change, but this effect will not be discussed further. The pressure increase with time for such a condition is illustrated in FIG. 6. The point H represents the distance from the wellhead to the depth where the fluid flow changes from single-phase liquid flow from below, to multiphase flow above. It is the wellbore depth where the pressure corresponds to the bubble-point pressure of the hydrocarbon fluid. Depending of the particular situation, the line-packing pressure from the wellhead to point H may or may not be linear. Non-linear effects arise because of the nature of gas-liquid mixtures and multiphase flow. In FIG. 6 the line-packing pressure below point H is shown linear, indicating single-phase flow and constant wellbore diameter.

In FIG. 5 the flowrate of liquid hydrocarbon changed at point G and in FIG. 6 the fluid flow changed from single-phase to multiphase at point H. In gas-lift wells two types of flow situations arise. First, a situation where gas enters the wellbore tubing (through a gas-lift valve) where single-phase liquid flows from below, such that gas-liquid flow continues up the tubing to the wellhead. Second, a situation where gas enters the wellbore tubing (through a gas lift valve) where multiphase gas-liquid mixture flows from below, such that a gas-rich mixture continues up the tubing to the wellhead. It should be noted that both such situations could be illustrated in figures similar to FIGS. 5 and 6. Pressure surveys in gas-lift valves can be used to locate which of several gas-lift valves is operating.

FIGS. 1–6 illustrate the increase in water-hammer pressure when a quick-acting valve is closed according to the invention, and the subsequent gradual increase in line-packing pressure with time. The figures illustrate simplified situations, and the points A–H represent for each situation a particular distance ΔL. To calculate this particular distance, fluid flow equations and fluid properties need to be known. In single-phase flow of fluids with constant pressure-volume-temperature (PVT) properties, the calculations are simple and explicit. In multiphase flow of fluids with variable PVT-properties, however, the calculations needed are more involved and implicit.

The following steps describes how the distance ΔL might be calculated for the particular situation illustrated in FIG. 6, where the point H represents the distance to the bubble-point pressure in the wellbore:

1. A pressure pulse test is made and the mass flowrate of the gas-liquid mixture flowing at the wellhead is calculated from the water-hammer equation, and the wellhead temperature is measured.
2. The pressure-volume-temperature properties of the gas-liquid mixture flowing in the wellbore are assumed known from standard oilfield practices, based on measurements and/or established correlations.
3. An established wellbore flow simulator is then used to calculate the wellbore pressure and temperature from the wellhead to downhole, including fluid densities and void fraction.
4. The speed of sound in the flowing gas-liquid mixture is then calculated piecewise from the wellhead to bottomhole, using fundamental relationships and the wellbore simulation results.
5. The time-scale in FIG. 6 is converted to distance in a piecewise manner using the relationship $\Delta L=0.5\ a\ \Delta t$.

The above calculations can be carried out using data and models that range from simple to comprehensive. The more accurate the data and the more accurate the models, the more accurate the results. The accuracy of the calculations can also be improved by additional measurements and other information. For example, pressure measurements from a downhole gauge can be matched to the arrival of the pressure pulse. And the known locations/depths of changes in tubing diameter and other completion features, can be matched to their appearance in the line-packing signal measured at the wellhead. Similarly, downhole temperature measurements can be used to improve the accuracy of pressure profiles in wellbores; either point measurements or distributed measurements.

Distributed temperature measurements can be made using optical fibre technology. Such measurements can be made inside or outside the production tubing, and can be configured to give the temperature at fixed intervals from the wellhead to wellbottom. Distributed temperature measurements are sensitive to the start-up and shut-in of oil and gas wells. The temperature profile in a well that has produced for a relatively long time, will be more stable with time than the temperature profile in a well that has recently been started-up or shut-in (E. Ivarrud, (1995): A *Temperature Calculations in Oil Wells@*, Engineering Thesis, Department of Petroleum Engineering and Applied Geophysics, Norwegian Institute of Technology, Trondheim.). Distributed temperature measurements made outside the production tubing will take a longer time to respond to changes in the temperature profile inside the tubing than direct measurements (distributed temperature measurements inside the tubing).

The combination of a pressure pulse flowrate measurement, a wellbore pressure profile measurement and a distributed temperature measurement, gives similar information as obtained from running a production logging tool (PLT).

EXAMPLES

Practical pressure pulse tests/measurements have been made in multiphase wells in the North Sea on the Oseberg and Gullfaks A and B platforms. The tests/measurements have shown that the theories expressed by the Joukowsky equation (water-hammer), the Darcy-Weisbach equation (line-packing) and the Wood equation (wave propagation), are applicable in the relevant situations.

The offshore tests have shown that the line-packing pressure measured at the wellhead, contains more information than the mass flowrate and mixture density patented by Gudmundsson (Norwegian patents Nos. 174 643 and 300 437). The additional line-packing information includes the effects illustrated in FIGS. 2–6, and other effects of interest in the monitoring and logging of oil and gas wells.

Two line-packing situations have been studied to illustrate the present invention. Models developed and tested for petroleum production operations were used to calculate the line-packing pressure in the two situations.

Example 1

The first situation is an offshore oil well producing at conditions typical in the North Sea, with a multiphase transition as shown schematically in FIG. 6. The water-hammer and line-packing were calculated for an offshore production well assuming the following conditions:

Wellhead pressure, 90 bar.
Mixture flow rate, 2600 Sm3/day (25.58 kg/s).
Mixture density, 850 kg/m3.
Mixture velocity at wellhead, 1.8 m/s.
Speed of sound in mixture at wellhead, 350 m/s.
Water-hammer at wellhead, 5.36 bar.
Total length, 4500 m.
Wellbore diameter, 0.127 m.
Friction factor, 0.020.

Based on results from a steady-state wellbore flow simulator and Wood=s equation, the speed-of-sound in the gas-liquid mixture from the wellhead to downhole was estimated. The speed-of-sound profile is shown in FIG. 7, increasing from 350 m/s at the wellhead to 730 m/s at 1820 m depth, corresponding to the bubble point pressure. Based on results from a transient pressure pulse simulator, the water-hammer and line-packing were estimated and plotted in FIG. 8. The well was vertical to 2000 m depth and deviated (to horizontal) to 2650 m depth at 4500 m total length.

In FIG. 8 the wellhead pressure of 90 bar is shown from time zero to about 2.5 seconds. Then the quick-acting valve closes in about one-half second; at 3 seconds the valve is fully closed and the water-hammer pressure of 95.36 bar is reached. After that the line-packing increases gradually and then more rapidly until at about 6.5 seconds, when the multiphase to single-phase transition is reached, corresponding to the depth where the wellbore pressure equals the bubble-point pressure. At greater depths the line-packing increases linearly with time, indicating single-phase flow in a constant diameter wellbore.

The line-packing pressure in FIG. 8 can be related to wellbore depth through modeling. The relationship between wellbore depth and time is shown in FIG. 9. Therefore, through pressure pulse measurements at the wellhead, it is possible to calculate the wellbore pressure profile with depth. Pressure pulse measurements at the wellhead give the line-packing pressure with time, and modelling gives the wellbore pressure profile.

Example 2

The second example concerns a horizontal flowline/pipeline flowing a multiphase gas-liquid mixture, where solids deposition restricts the flow in a particular interval. The water-hammer and line-packing were calculated for a horizontal flowline/pipeline flowing a multiphase gas-liquid mixture, where solids deposition restricts the flow in a particular interval. The following conditions were assumed:
Flowline/pipeline length, 2 km.
Internal diameter, 0.1024 m.
Oil density, 850 kg/m3.
Gas specific gravity, 0.8 (–).
Average speed-of-sound in mixture, 250 m/s.
Flowline inlet pressure, 35 bar.
Friction factor, 0.023 (–).
Average temperature, 40 C.
Gas-oil-ratio, 400 scf/STB.
Total flowrate 8 kg/s.

The flowline/pipeline with solids deposition used in the calculations is shown in FIG. 10. The flow is from left to right; the outlet pressure was calculated 30 bar, based on multiphase gas-liquid flow. The quick-acting valve is located at the low-pressure down-stream end of the flowline, and was assumed to take about 1 second to close. Quick-acting hydraulically activated valves can be closed in about one-tenth of a second. Most manually operated valves in petroleum production operations can be closed in a couple of seconds; however, most of the closing action occurs after about 80% of the movement.

The solids deposition in FIG. 10 starts at some distance from the closing valve. The thickness of the deposits increases the first 100 m (diameter reduces from 10.24 cm to 9.84 cm) and then remains constant for 300 m (diameter 9.84 cm) and then decreases in thickness the last 100 m (diameter increases from 9.84 cm to 10.24 cm). The pressure pulse travels from the quick-acting valve and up-stream the flowline/pipeline.

The water-hammer and line-packing pressure calculated for the flowline/pipeline are shown in FIG. 11, for the assumed mass flowrate of 8 kg/s. The initial pressure increase from 30 bar to about 32.5 bar is the water-hammer pressure and the more gradual pressure increase is the line-packing pressure. Experience from the Oseberg and Gullfaks A and B fields has shown that the water-hammer and line-packing pressures can easily be measured using off-the-shelf pressure transducers.

The calculations shown in FIG. 11, were carried out for deposits located 500–1000 m up-stream of the quick-acting valve. The water-hammer and line-packing are plotted in FIG. 11 along with the line-packing pressure for a clean (without solids deposition) flowline/pipeline. The figure shows how a 500 m long solids deposit affects the line-packing pressure in the 2 km long flowline/pipeline.

Analysis of the line-packing pressure shown in FIG. 11, makes it possible to locate the solids deposit, to estimate the thickness of the deposit, and its total length. Such analysis will include the measurement of mass flowrate by the patented pressure pulse testing of Gudmundsson (Norwegian patent No. 300 437).

To summarize the method according to the present invention is effective to make a pressure profile measurement in wells flowing multiphase mixtures, and in wells flowing single-phase liquid and in wells flowing single-phase gas. It is also effective to make pressure profile measurements in flowlines (the various pipelines connecting wells and subsea templates and further to platforms and pipes from wellhead to processing etc.) and pipelines (the longer type).

The method can be used to detect and monitor changes in wellbore/flowline/pipeline fluid flow related properties, including changes in effective flow diameter, wall friction and flow rates and fluid composition, etc. Such changes can be used in the analysis of wellbore/flowline/pipeline condition.

The method can be combined with distributed temperature measurements to make simultaneous pressure and temperature profile measurements in wellbores, when combined with a pressure pulse flowrate measurement, thus give information similar to conventional production logging tools.

While the most complete set of data is obtained by measuring during and after a complete shut-off, a lot of information is obtainable also if the valve is only partly closed, which might be easier to handle in a production situation.

While some preferred forms of the invention have been described in the examples and with reference to the drawings, variations will be apparent to those skilled in the art. Thus, the invention is not limited to the embodiments described, and modifications may be made therein without departing from the spirit and the scope of the invention as defined in the appended claims.

What is claimed is:

1. Method for determining pressure profiles in wellbores, flowlines and pipelines flowing singlephase or multiphase fluids, wherein the flow is temporarily closed or partly closed with a quick acting valve and the pressure is continuously recorded at a point a short distance upstream, using the Darcy-Weisbach equation:

$$\Delta p_f = \left(\frac{f}{2}\right)\left(\frac{\Delta L}{d}\right)\rho u^2$$

where f (dimensionless) is the friction factor, L (m) is the pipe length, d (m) is the pipe diameter, ρ (kg/m3) is the fluid density and u (m/s) is the fluid velocity, to determine the frictional pressure drop, while a distance-log of pressure change is obtained from a time-log and an estimate of the speed of sound in the actual fluid, while using the formula:

$$\Delta L = 0.5\ a\ \Delta t$$

where a is the speed of sound in the fluid, to obtain the relation between time (Δt) and distance (ΔL) and thereby obtaining the pressure profiles.

2. Method for determining pressure profiles according to claim 1 wherein the estimate of the speed of sound is based on the time between abrupt pressure changes on the time-log inflicted by equipment, change of flow area with known positions along the wellbore, flowline or pipeline.

3. Method for determining pressure profiles according to claim 1 wherein the estimate of the speed of sound is based on measurement of and comparison between time-logs made at least at two different positions along the flowline.

4. Method according to claim 1 for obtaining a combined pressure- and temperature-log, wherein a temperature log is measured using optical fibers with depth in the wellbore.

5. Use of the method according to claim 1 to detect and locate inflow into a wellbore, a flowline or a pipeline.

6. Use of the method according to claim 1 to detect and locate flowline collapse or other failures.

7. Use of the method according to claim 1 to determine the effective diameter of the wellbore, flowline or pipeline at various locations.

8. Use of the method according to claim 1 to detect and locate deposits in the form of hydrates, wax, asphaltenes or sand.

9. Use of the method according to claim 1 to detect and locate leakages.

10. Use of the method according to claim 1 to detect which of several gas-lift valves that is/are operating.

11. Use of the method according to claim 1 to locate and quantify the performance of flow equipment used in the oil and/or gas production.

12. Method according to claim 1, characterized in using the relations known from the Joukowsky equation:

$$\Delta p_a = \rho u a$$

where ρ (kg/m3) represents the fluid density, u (m/s) the fluid flowing velocity and a (m/s) the speed of sound in the fluid, to estimate the speed of sound in the fluid.

* * * * *